US011235597B2

(12) United States Patent
Kaneko et al.

(10) Patent No.: US 11,235,597 B2
(45) Date of Patent: Feb. 1, 2022

(54) IMAGE FORMING APPARATUS AND METHOD OF CORRECTING POSITIONAL DEVIATION OF SHEET

(71) Applicants: Takaaki Kaneko, Kanagawa (JP); Motoharu Takahashi, Kanagawa (JP); Yuichiro Maeyama, Kanagawa (JP); Tomohiro Egawa, Kanagawa (JP)

(72) Inventors: Takaaki Kaneko, Kanagawa (JP); Motoharu Takahashi, Kanagawa (JP); Yuichiro Maeyama, Kanagawa (JP); Tomohiro Egawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 427 days.

(21) Appl. No.: 16/257,179

(22) Filed: Jan. 25, 2019

(65) Prior Publication Data

US 2019/0241385 A1 Aug. 8, 2019

(30) Foreign Application Priority Data

Feb. 8, 2018 (JP) ..... JP2018-020986

(51) Int. Cl.

| | |
|---|---|
| ***B41J 25/00*** | (2006.01) |
| ***B65H 9/10*** | (2006.01) |
| ***B65H 5/06*** | (2006.01) |
| ***B41J 11/00*** | (2006.01) |
| ***B65H 9/00*** | (2006.01) |

(Continued)

(52) U.S. Cl.

CPC ..... *B41J 11/008* (2013.01); *B41J 2/04505* (2013.01); *B41J 13/0018* (2013.01); *B65H 5/062* (2013.01); *B65H 9/002* (2013.01); *B65H 9/10* (2013.01); *B65H 2404/144* (2013.01);

(Continued)

(58) Field of Classification Search

CPC .. B41J 11/008; B41J 2/04505; G01G 15/6567

See application file for complete search history.

(56) References Cited

U.S. PATENT DOCUMENTS

| | | | | |
|---|---|---|---|---|
| 2007/0145667 A1* | 6/2007 | Pasuch | ..... | B65H 9/002 271/37 |
| 2016/0159598 A1* | 6/2016 | Yamane | ..... | B65H 9/002 271/227 |

FOREIGN PATENT DOCUMENTS

| | | |
|---|---|---|
| JP | 6-234441 | 8/1994 |
| JP | 9-175694 | 7/1997 |

(Continued)

*Primary Examiner* — Daniel J Colilla

(74) *Attorney, Agent, or Firm* — Harness, Dickey & Pierce, P.L.C.

(57) ABSTRACT

An image forming apparatus, in which a method of correcting a positional deviation of a sheet is performed, includes a detecting device to detect a position of the sheet, a pair of sheet conveying bodies to convey the sheet and correct the positional deviation of the sheet, an image forming device to form an image on the sheet, and circuitry to calculate a first positional deviation amount of the sheet based on a first detection result of the detecting device, cause the pair of sheet conveying bodies to correct the positional deviation of the sheet based on the first positional deviation amount, calculate a second positional deviation amount of the sheet based on a second detection result of the detecting device, and cause the image forming device to correct the positional deviation of an image forming position on the sheet based on the second positional deviation amount.

16 Claims, 14 Drawing Sheets

(51) Int. Cl.
*B41J 2/045* (2006.01)
*B41J 13/00* (2006.01)

(52) U.S. Cl.
CPC ..... *B65H 2404/1424* (2013.01); *B65H 2404/14212* (2013.01)

(56) References Cited

FOREIGN PATENT DOCUMENTS

| | | | | |
|---|---|---|---|---|
| JP | 10-067448 | | | 3/1998 |
| JP | 10-120253 | | | 5/1998 |
| JP | 2005-041603 | | | 2/2005 |
| JP | 2005-041604 | | | 2/2005 |
| JP | 2005-053646 | | | 3/2005 |
| JP | 2005-178929 | | | 7/2005 |
| JP | 2005263463 | A | * | 9/2005 |
| JP | 2005-027859 | | | 2/2006 |
| JP | 2008-239348 | | | 10/2008 |
| JP | 2008-254843 | | | 10/2008 |
| JP | 2009-143643 | | | 7/2009 |
| JP | 2010139889 | A | * | 6/2010 |
| JP | 2011-098790 | | | 5/2011 |
| JP | 2014-088263 | | | 5/2014 |
| JP | 2016-108152 | | | 6/2016 |
| JP | 2016-175776 | | | 10/2016 |

* cited by examiner

IMAGE FORMING APPARATUS AND METHOD OF CORRECTING POSITIONAL DEVIATION OF SHEET

CROSS-REFERENCE TO RELATED APPLICATION

This patent application is based on and claims priority pursuant to 35 U.S.C. § 119(a) to Japanese Patent Application No. 2018-020986, filed on Feb. 8, 2018, in the Japan Patent Office, the entire disclosure of which is hereby incorporated by reference herein.

BACKGROUND

Technical Field

This disclosure relates to an image forming apparatus that corrects positional deviations of a sheet and an image to be formed on the sheet and a method of correcting a positional deviation of a sheet.

Related Art

Image forming apparatuses for forming an image on a sheet cause a positional deviation of a sheet during sheet conveyance, and therefore cause a positional deviation of an image to be formed on the sheet.

Such image forming apparatuses include a detecting mechanism that detects a position of a sheet in order to calculate the amount of positional deviation of the sheet so that the positional deviation of the sheet is corrected before image formation.

Known image forming apparatuses have proposed a technique in which a detecting mechanism including contact image sensors or skew detection sensors detects the position of a sheet and calculates the amount of positional deviation of the sheet. Then, based on the calculated amount of positional deviation of the sheet, a sheet gripping roller that grips the sheet conveys the sheet toward a downstream side in a sheet conveying direction while correcting the positional deviation of the sheet. Then, the sheet is conveyed to an image forming position where an image is formed on the sheet after the positional deviation of the sheet is corrected.

In a known image forming apparatus such as the known image forming apparatus that corrects the positional deviation of a sheet while conveying the sheet by a sheet conveying member such as the sheet gripping roller, it is expected that the positional deviation of the sheet is corrected during a time period from when the sheet reaches the sheet conveying member to when the sheet is conveyed to a downstream side roller. Therefore, in a case in which the sheet has a large amount of positional deviation, the known image forming apparatus cannot complete the correction of the positional deviation of the sheet while the sheet is being conveyed by the sheet gripping roller, and therefore the sheet is conveyed to the image forming position with the positional deviation. The above-described inconvenience may be solved by reducing the sheet conveying speed by the sheet conveying member. However, this reduction in the sheet conveying speed results in degradation in the productivity of the image forming apparatus.

SUMMARY

At least one aspect of this disclosure provides an image forming apparatus including a detecting device, a pair of sheet conveying bodies, an image forming device, and circuitry. The detecting device is configured to detect a position of a sheet. The pair of sheet conveying bodies is configured to convey the sheet and correct a positional deviation of the sheet. The image forming device is configured to form an image on the sheet. The circuitry is configured to calculate a first positional deviation amount of the sheet based on a first detection result of the position of the sheet by the detecting device, cause the pair of sheet conveying bodies to correct the positional deviation of the sheet based on the first positional deviation amount, calculate a second positional deviation amount of the sheet based on a second detection result of the position of the sheet by the detecting device, and cause the image forming device to correct an image forming position on the sheet based on the second positional deviation amount.

Further, at least one aspect of this disclosure provides a method of correcting a positional deviation of a sheet, the method including detecting a position of the sheet by a plurality of image sensors, calculating a first positional deviation amount of the sheet based on a first detection result of the position of the sheet, causing a pair of sheet conveying bodies to correct the positional deviation of the sheet based on the first positional deviation amount, detecting the position of the sheet again, calculating a second positional deviation amount of the sheet based on a second detection result of the position of the sheet, and causing an image forming device to correct an image forming position on the sheet based on the second positional deviation amount.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
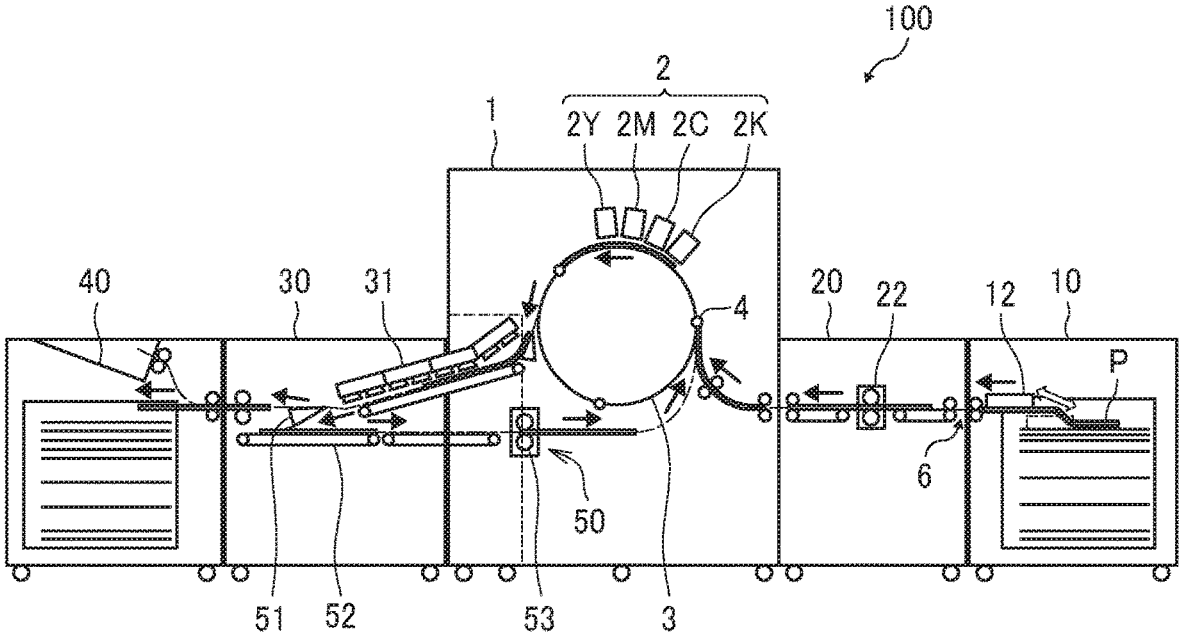
FIG. 1 is a diagram illustrating a schematic configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to an image forming apparatus, with reference to the following figures.

It is to be noted that identical parts are given identical reference numerals and redundant descriptions are summarized or omitted accordingly.

Next, a description is given of a series of image forming operations performed by an image forming apparatus 100 according to an embodiment of this disclosure, for forming an image on a sheet.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an inkjet copier that forms images on recording media by discharging ink.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

FIG. 1 is a diagram illustrating a schematic configuration of the image forming apparatus 100 according to an embodiment of this disclosure. In FIG. 1, the image forming apparatus 100 includes a sheet feeding device 10, an air separation device 12, an image forming device 1, and a sheet conveying device 20. The sheet feeding device 10 contains a bundle of sheets including a sheet P. The air separation device 12 blows air toward the bundle of sheets to separate the sheet P that is placed on top of the bundle of sheets that is loaded on a sheet loader of the sheet feeding device 10. The sheet P is separated from the other sheets of the bundle of sheets one by one and picked up by the air separation device 12. The sheet P picked up by the air separation device 12 is conveyed toward the image forming device 1, via the sheet conveying device 20 that is disposed downstream from the sheet feeding device 10 in a sheet conveying direction.

The sheet P that has been conveyed from the sheet feeding device 10 reaches the sheet conveying device 20. The sheet conveying device 20 includes a pair of sheet gripping rollers 22 to correct the positional deviation of the sheet P. After the positional deviation of the sheet P is corrected by the sheet conveying device 20, the sheet P is conveyed to the image forming device 1 at a predetermined timing.

The image forming device 1 includes a cylindrical drum 3 and sheet grippers 4 mounted on the circumferential surface of the cylindrical drum 3. The sheet grippers 4 grip the leading end of the sheet P when the sheet P is conveyed to the image forming device 1.

After the positional deviation of the sheet P is corrected and the sheet P is conveyed to the image forming device 1, the leading end of the sheet P is gripped by the sheet grippers 4 mounted on the circumferential surface of the cylindrical drum 3, so that the sheet P is positioned on the circumferential surface of the cylindrical drum 3. In addition, the cylindrical drum 3 has multiple air intake holes formed in circumferential surface thereof. By sucking air through the multiple air intake holes from the back side of the sheet P, the whole area of the sheet P is closely attached onto the circumferential surface of the cylindrical drum 3 to hold the sheet P. As the cylindrical drum 3 is rotated in a direction indicated by arrow in FIG. 1, the sheet P that is positioned by the sheet grippers 4 and closely attached to the surface of the cylindrical drum 3 by sucking air from the back side is conveyed toward the head unit 2.

Figure 2:
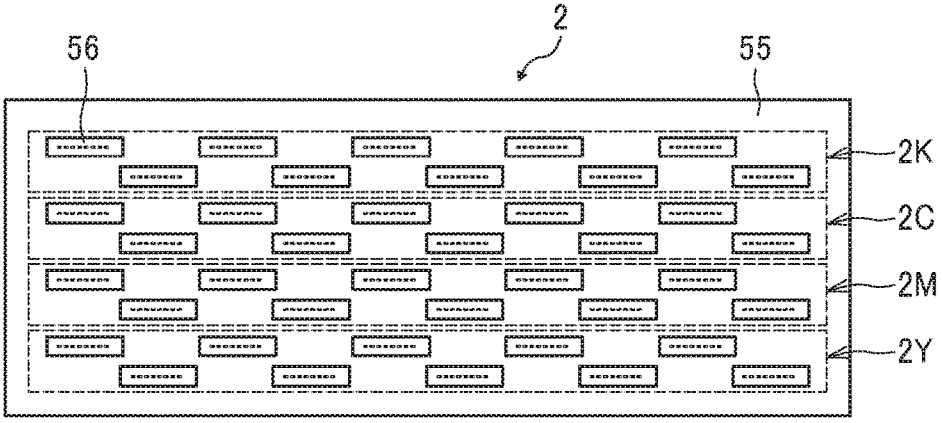
FIG. 2 is a diagram illustrating arrangements of ink discharge heads of a head unit.

FIG. 2 is a diagram illustrating arrangements of multiple ink discharge heads 56 of the head unit 2. The head unit 2 includes head arrays 2K, 2C, 2M, and 2Y disposed along the circumferential surface of the cylindrical drum 3. The head arrays 2K, 2C, 2M, and 2Y discharge black, cyan, magenta, and yellow ink, respectively.

As illustrated in FIG. 2, the head unit 2 includes a base 55 and the multiple ink discharge heads 56 in zigzag arrangement on the base 55. The ink discharge heads 56 of the head arrays 2K, 2C, 2M, and 2Y described above are arranged in the order (see groups surrounded by broken lines in FIG. 2). However, the type and number of colors and the arrangements of the multiple ink discharge heads 56 are not limited to this configuration.

As illustrated in FIG. 1, the sheet P that is attached to the circumferential surface of the cylindrical drum 3 is conveyed under the head unit 2 where ink (liquid) of each color is discharged from the head unit 2 at a predetermined timing. Accordingly, an image is formed on the surface of the sheet P. The sheet grippers 4 according to the present embodiment include three sheet grippers mounted on the circumferential surface of the cylindrical drum 3. According to this configuration, while the cylindrical drum 3 rotates for one round, images are formed on three sheets P.

The sheet P on which the image is formed by the image forming device 1 is conveyed to a drying device 30. The drying device 30 includes a drying unit 31. The sheet P passes through the lower part of the drying unit 31, so that moisture in ink discharged onto the sheet P is evaporated, and consequently curling of the sheet P is prevented.

The sheet P that has passed through the drying device 30 is conveyed to a sheet output device 40, so that the sheets P are stacked on the sheet output device 40 in an orderly arranged state.

The drying device 30 further includes a sheet direction switching portion 51 and a sheet reversing and conveying member 52. When performing duplex printing, the sheet P is reversed by the sheet direction switching portion 51 and conveyed by the sheet reversing and conveying member 52 toward the image forming device 1. After switching the conveying direction of the sheet P by the sheet direction switching portion 51, the sheet P is conveyed toward the image forming device 1 by the sheet reversing and conveying member 52. The sheet P reaches a sheet conveying device 50 before reaching the cylindrical drum 3. The sheet conveying device 50 functions as a second sheet conveying device. Similar to the sheet conveying device 20, a pair of sheet gripping rollers 53 provided to the sheet conveying device 50 corrects the positional deviation of a sheet while conveying the sheet P. After completion of correction of the positional deviation, the sheet P is conveyed to the cylindrical drum 3, where the sheet P is gripped by one of the sheet gripper 4 and is attached and held onto the circumferential surface of the cylindrical drum 3 with the back face having no image thereon facing up. Then, in the image forming device 1, as described above for forming an image on a front face of the sheet P (i.e., a single-side printing), the head unit 2 forms an image on the back face (with no image formed) of the sheet P that is attached onto the circumferential surface of the cylindrical drum 3.

After passing through the drying device 30, the sheet P has respective images on both sides. Then, similar to the single-side printing, the sheet P is conveyed to the sheet output device 40 and is stacked on the sheet output device 40 in the orderly arranged state.

Next, a description is given of details of the configuration of the sheet conveying device 20 included in the image forming apparatus 100.

Figure 3A:
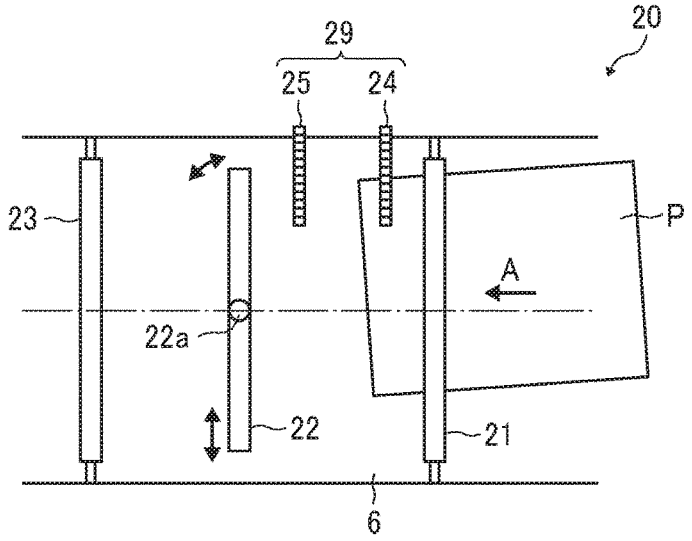
FIG. 3A is a plan view illustrating a configuration of a sheet conveying device according to an embodiment of this disclosure.
Figure 3B:
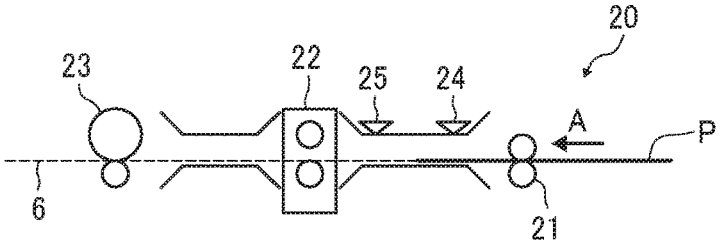
FIG. 3B is a side view of FIG. 3A.

FIG. 3A is a plan view illustrating a configuration of the sheet conveying device 20. FIG. 3B is a side view of FIG. 3A. As illustrated in FIGS. 3A and 3B, the sheet conveying device 20 includes a pair of upstream side sheet conveying rollers 21, the pair of sheet gripping rollers 22 that functions as a pair of sheet conveying bodies, a pair of downstream side sheet conveying rollers 23, and a detecting device 29. Hereinafter, the sheet conveying direction of the sheet P is also simply referred to as a "sheet conveying direction" (i.e., a direction indicated by arrow A in FIGS. 3A and 3B). In addition, an upstream side of the sheet conveying direction and a downstream side of the sheet conveying direction are also simply referred to as an "upstream side" and a "downstream side", respectively.

Each of the pair of upstream side sheet conveying rollers 21, the pair of sheet gripping rollers 22, and the pair of downstream side sheet conveying rollers 23 includes sheet conveying rollers as a pair of rollers. Each of the pair of upstream side sheet conveying rollers 21, the pair of sheet gripping rollers 22, and the pair of downstream side sheet conveying rollers 23 rotates while gripping the sheet P in a nip region formed between the rollers of the pair, so that the sheet P is conveyed to the downstream side. It is to be noted that the pair of upstream side sheet conveying rollers 21, the pair of sheet gripping rollers 22, and the pair of downstream side sheet conveying rollers 23 are arranged in this order along the sheet conveying direction.

The pair of sheet gripping rollers 22 is rotatable about a pivot point 22*a* within a plane of sheet conveyance and is movable in the width direction of the sheet P. Through the above-described operations, the pair of sheet gripping rollers 22 rotates the sheet P or moves the sheet P in the width direction while gripping the sheet P, so as to correct the angular displacement of the sheet P or the lateral displacement of the sheet P. It is to be noted that rotations of the pair of sheet gripping rollers 22 are hereinafter distinguished by describing differently. That is, the rotation of the pair of sheet gripping rollers 22 to convey the sheet P is referred to as a "rotation" or a "rotation for sheet conveyance" and the rotation of the pair of sheet gripping rollers 22 to correct the angular displacement of the sheet P is referred to as a "rotation within a plane of sheet conveyance".

The detecting device 29 includes a first CIS 24 and a second CIS 25, both of which function as detectors. The first CIS 24 and the second CIS 25 are arranged along the sheet conveying direction. Each of the first CIS 24 and the second CIS 25 is a contact image sensor that includes photosensors, each of which including multiple light emitting elements such as LEDs (that is, light emitting diodes) and multiple light receiving elements such as photodiodes. The photosensors including the multiple light emitting elements and the multiple light receiving elements are aligned in the width direction of the sheet P.

Now, a detailed description is given of operations of processes in which the sheet conveying device 20 corrects the positional deviation of the sheet P while conveying the sheet P, with reference to FIGS. 3A through 9.

Figure 6:
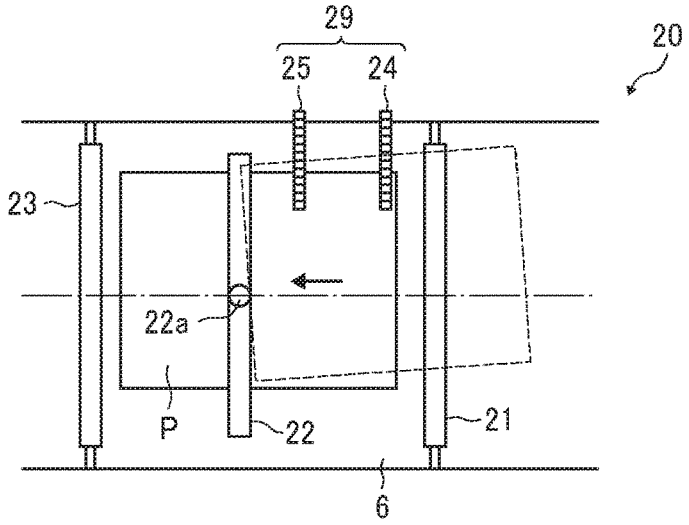
FIG. 6 is a plan view illustrating a subsequent process of sheet conveyance performed by the sheet conveying device of FIG. 5.
Figure 7:
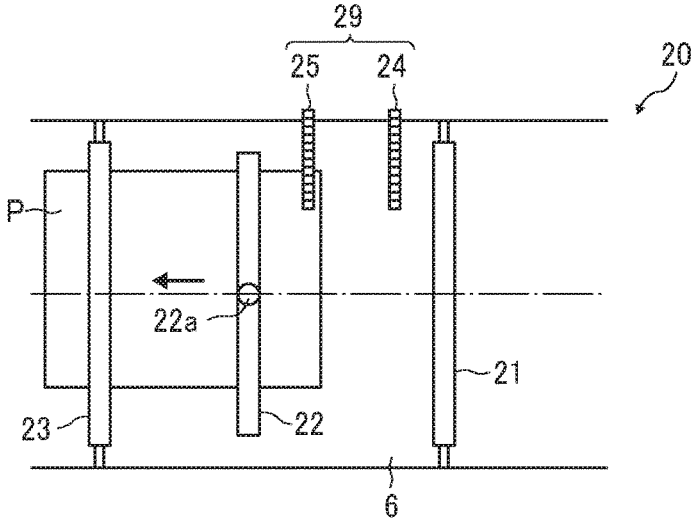
FIG. 7 is a plan view illustrating a subsequent process of sheet conveyance performed by the sheet conveying device of FIG. 6.
Figure 8:
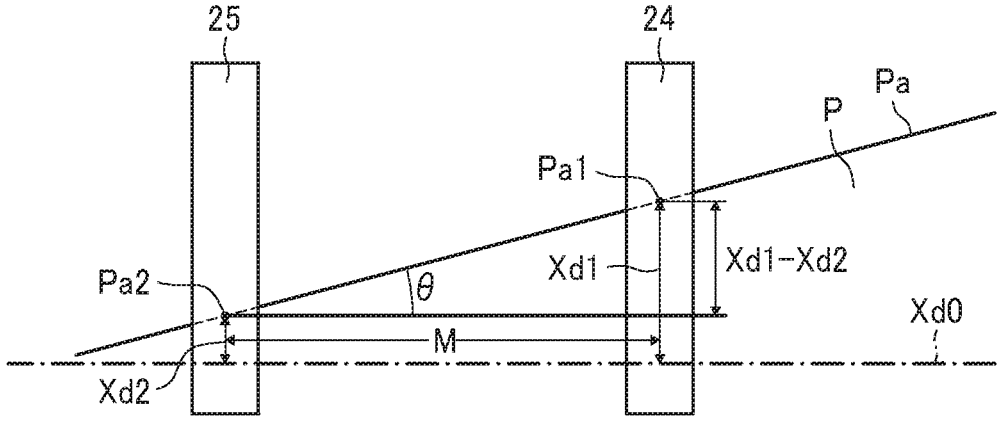
FIG. 8 is a plan view for explaining a method of calculating a positional amount of a sheet.
Figure 9:
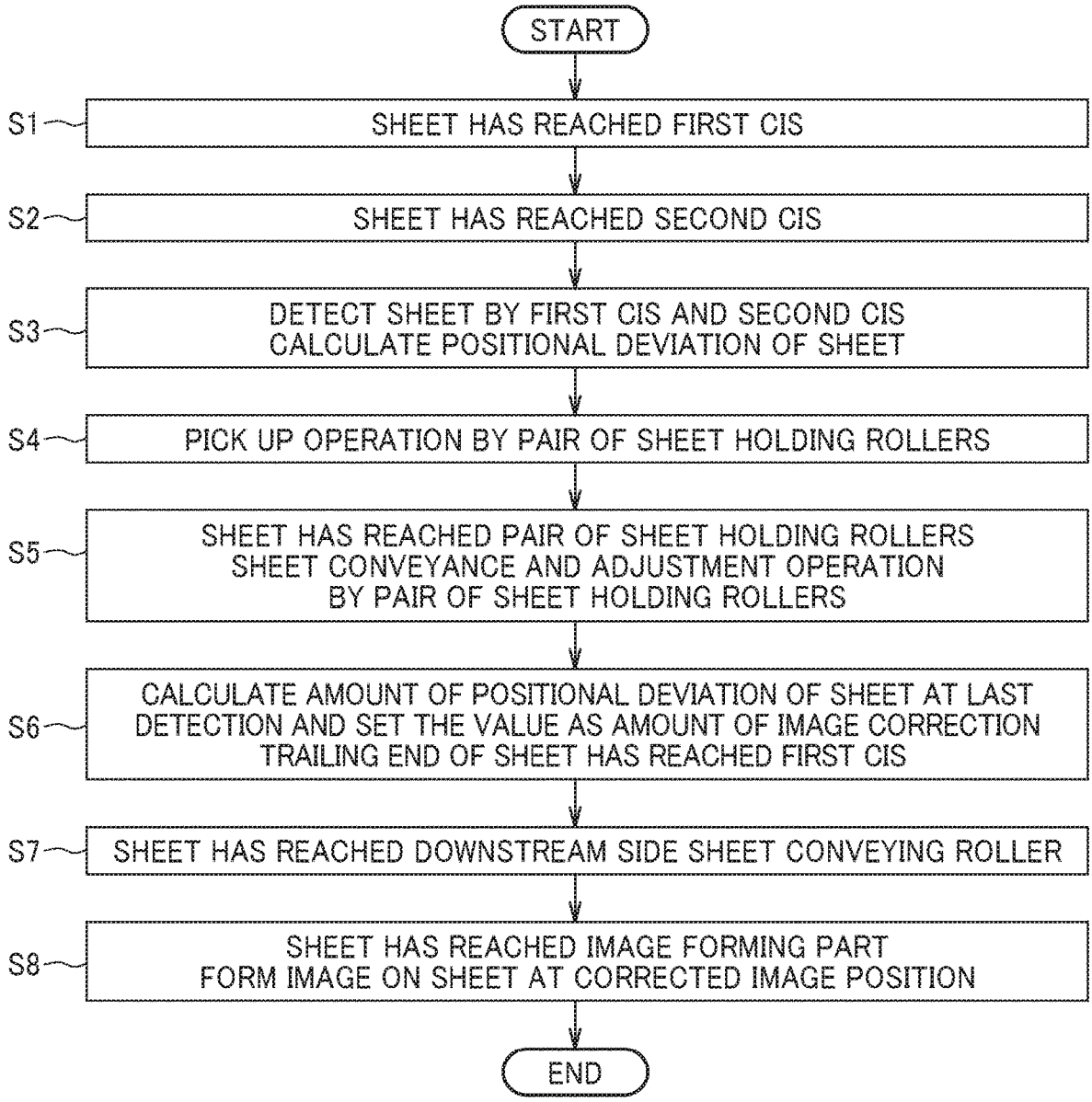
FIG. 9 is a flowchart of sheet conveyance to image formation to a sheet performed by the image forming apparatus.

FIGS. 3A through 7 are plan views illustrating processes of sheet conveyance by the sheet conveying device 20. FIG. 3B is a side view of FIG. 3A. FIG. 8 is a plan view for explaining a method of calculating an amount of positional deviation of a sheet P. FIG. 9 is a flowchart of sheet conveyance to image formation to a sheet P performed by the image forming apparatus 100.

First, as illustrated in FIG. 3A, as the pair of upstream side sheet conveying rollers 21 grips and conveys the sheet P toward the downstream side of the sheet conveying direction, the sheet P reaches the first CIS 24 (step S1 in the flowchart of FIG. 9). Then, the first CIS 24 detects the position of the sheet P.

Figure 4:
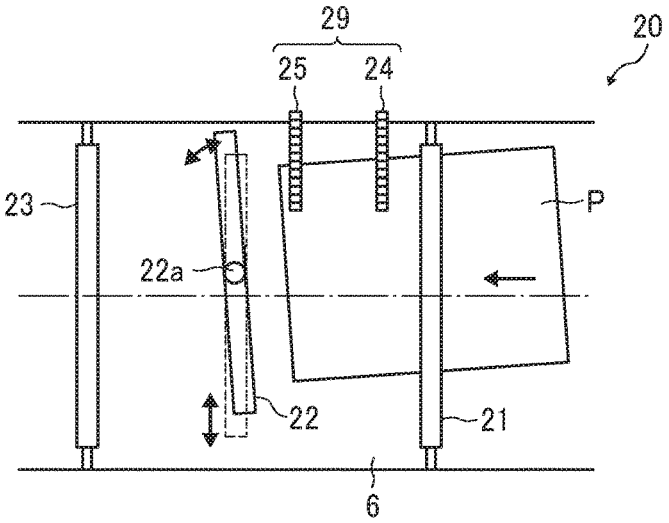
FIG. 4 is a plan view illustrating a process of sheet conveyance performed by the sheet conveying device.

As the sheet P is further conveyed to the downstream side, the sheet P reaches the second CIS 25, as illustrated in FIG. 4 (step S2 in the flowchart of FIG. 9). When the sheet P reaches the second CIS 25, an amount of positional deviation of the sheet P is calculate based on detection results of a first detection by the first CIS 24 and the second CIS 25 (step S3 in the flowchart of FIG. 9).

Referring to FIG. 8, a description is given of a specific method of calculating the positional deviation of the sheet P.

As illustrated in FIG. 8, the first CIS 24 and the second CIS 25 are capable of detecting a boundary of a sheet area and a non-sheet area, and therefore the first CIS 24 detects a lateral position Pa1 of a side end Pa of the sheet P and the second CIS 25 detects a lateral position Pa2 of the side end Pa of the sheet P. Accordingly, a distance Xd1 from an ideal lateral position Xd0 of the sheet P to the lateral position Pa1 and a distance Xd2 from the ideal lateral position Xd0 to the lateral position Pa2 are calculated. The amount of positional deviation in the width direction of the sheet P can be obtained as, for example, an average value of these distances Xd1 and Xd2. An inclination angle θ (in other words, a skew amount θ) of the sheet P is calculated using a distance M in the sheet conveying direction between the first CIS 24 and the second CIS 25 and expressed as:

$$\mathrm{TAN}\ \theta=(Xd1-Xd2)/M \qquad \text{Equation 1.}$$

By using Equation 1, the angular displacement amount θ of the sheet P is obtained. It is to be noted that the distance M is a value that is previously measured.

Then, the pair of sheet gripping rollers 22 performs a pick up and operation based on the calculated amounts of lateral and angular displacements of the sheet P (step S4 in the flowchart of FIG. 9). In the pick up operation, the pair of sheet gripping rollers 22 moves from a home position by the amount of positional deviation of the sheet P in both a rotation direction for an angular displacement of the sheet P and a width direction for a lateral displacement of the sheet P. In other words, the pair of sheet gripping rollers 22 moves from a position in a broken line in FIG. 4 to a position in a solid line in FIG. 4 to pick up the sheet P having angular and lateral displacements in a state in which the pair of sheet gripping rollers 22 normally faces the sheet P. It is to be noted that the home position of the pair of sheet gripping rollers 22 is a position where the pair of sheet gripping rollers 22 is disposed facing a sheet conveyance passage 6 on the sheet conveyance passage 6, as illustrated in FIG. 3A.

Figure 5:
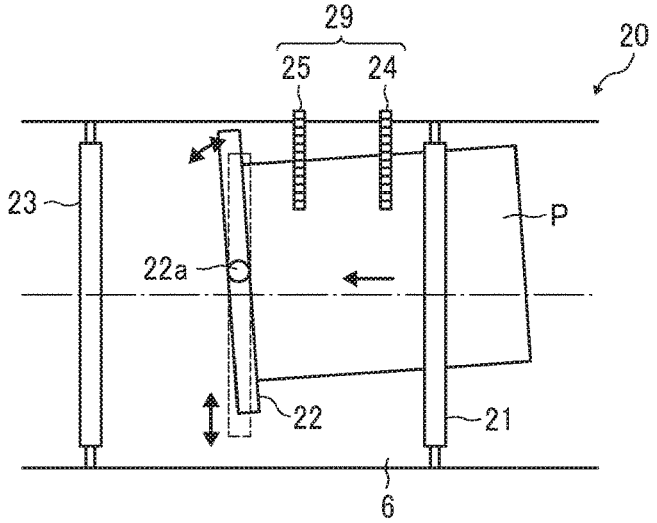
FIG. 5 is a plan view illustrating a subsequent process of sheet conveyance performed by the sheet conveying device of FIG. 4.

As the sheet P is further conveyed to the downstream side, the sheet P reaches the pair of sheet gripping rollers 22, as illustrated in FIG. 5 (step S5 in the flowchart of FIG. 9). At this time, the rollers of the pair of upstream side sheet conveying rollers 21 separate from each other to release the sheet P.

The pair of sheet gripping rollers 22 rotates, while gripping the sheet P, to convey the sheet P further to the downstream side. Concurrently with the sheet conveyance, the pair of sheet gripping rollers 22 perform an adjustment operation to correct the positional deviation of the sheet P (step S5 in the flowchart of FIG. 9). The adjustment operation is an operation in which the pair of sheet gripping rollers 22 rotates in the rotation direction within a plane of sheet conveyance and moves in the width direction based on the amount of positional deviation of the sheet P calculated in step S3, so as to correct the positional deviation of the sheet P.

As illustrated in FIG. 6, the sheet P is conveyed while the positional deviation of the sheet P is being corrected by the pair of sheet gripping rollers 22. Accordingly, the sheet P is conveyed to a position where the trailing end of the sheet P passes under the first CIS 24.

In the present embodiment, at the timing at which the trailing end of the sheet P passes under the first CIS 24 or at a timing earlier than the above timing, the first CIS 24 and the second CIS 25 detect the position of the sheet P (hereinafter, occasionally referred to as a "final detection"), so that the amount of positional deviation pf the sheet P is calculated (step S6 in the flowchart of FIG. 9). Hereinafter, the amount of positional deviation of the sheet P calculated by the final detection is also referred to as an "amount of image correction of the sheet P".

As described above, when calculating an amount of angular displacement of the sheet P, detection results of both of the first CIS 24 and the second CIS 25 are used. Therefore, as described above, the position where the trailing end of the sheet P passes under the first CIS 24 is the extreme downstream position at which the sheet P is detected and the amount of angular displacement of the sheet P is calculated. Therefore, by performing the final detection at the above timing and calculating the amount of positional deviation of the sheet P, the amount of positional deviation of the sheet P at a further downstream position is calculated.

In the present embodiment, in order to perform the final detection at a timing at the further downstream position, the first CIS 24 repeatedly detects the sheet P while the sheet P is being conveyed by the pair of sheet gripping rollers 22. Then, the amount of image correction of the sheet P is calculated based on the detection result of the first CIS 24 obtained by detecting the sheet P for the last time and the detection result of the second CIS 25 obtained by detecting the sheet P at the concurrent timing as the first CIS 24. (That is, the detections by the first CIS 24 and the second CIS 25 at this timing corresponds to the above-described final detection.) Accordingly, the amount of image correction of the sheet P is calculated based on a detection results obtained at the timing immediately before the trailing end of the sheet P passes under the first CIS 24. It is to be noted that, in this case, the second CIS 25 functions as an extreme downstream contact image sensor and the first CIS 24 functions as a second extreme downstream contact image sensor.

In the present embodiment, the first CIS 24 detects the sheet P repeatedly. However, the configuration is not limited thereto. For example, this disclosure may be applied to a configuration provided with a sensor to detect the sheet P directly or indirectly at a timing at which the leading end of the sheet P reaches the first CIS 24 and another sensor to detect the sheet P directly or indirectly at a timing at which the trailing end of the sheet P reaches the first CIS 24, and the respective timings at which these sensors detected the sheet P may trigger detection by the first CIS 24 for the pick up operation and the adjustment operation and detection by the first CIS 24 for the final detection.

When the final detection is performed, the pair of sheet gripping rollers 22 terminates the adjustment operation in the middle of the operation but continues sheet conveyance of the sheet P. Then, as illustrated in FIG. 7, when the sheet P reaches the pair of downstream side sheet conveying rollers 23 (step S7 in the flowchart of FIG. 9), the rollers of the pair of sheet gripping rollers 22 separate from each other to release the sheet P and ends the sheet conveyance of the sheet P. Thereafter, the sheet P is conveyed by the pair of downstream side sheet conveying rollers 23 further to the downstream side of the sheet conveying direction to the image forming device 1. It is to be noted that the pair of sheet gripping rollers 22 separated and released from the sheet P returns to the home position for preparing for sheet conveyance of a subsequent sheet P.

In the present embodiment, after the final detection, the correction of positional deviation of the sheet P is not performed until the sheet P is sent to the image forming device 1. In other words, the sheet P is sent to the image forming device 1 with the amount of positional deviation at the final detection.

In the image forming device 1, an image forming operation onto the sheet P is performed, that is, an image is formed on the sheet P. At this time, the image forming operation is performed in a state in which the image forming position at which an image is transferred from the image forming device 1 onto the sheet P is moved from an original image forming position by the amount of image correction of the sheet P (step S8 in the flowchart of FIG. 9).

Thus, in the present embodiment, the amount of positional deviation of the sheet P that has not been corrected by the pair of sheet gripping rollers 22 is set to be an amount of image correction of the sheet P. Then, by correcting the image forming position based on the amount of image correction of the sheet P, the image is formed on the correct position on the sheet P having the position deviation.

Now, a detailed description is given of a method of correcting the image forming position.

Figure 10:
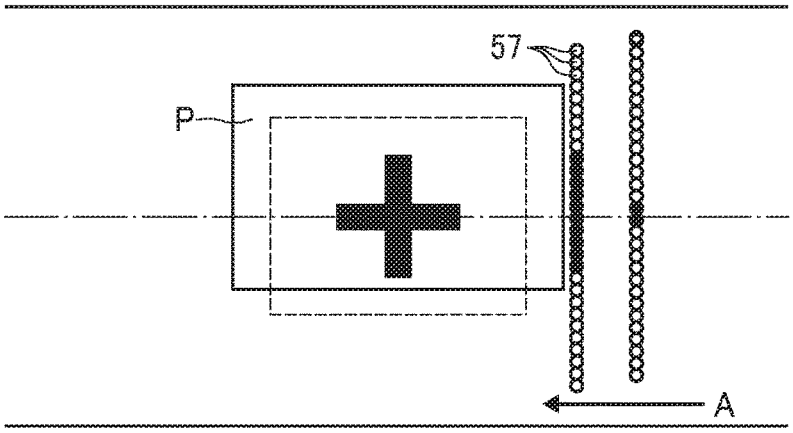
FIG. 10 is a plan view illustrating a state of image formation.

FIG. 10 is a plan view illustrating a sheet P that is conveyed to the image forming position and received an image on the surface.

As illustrated in FIG. 10, multiple ink discharging nozzles 57 are aligned along the width direction of the sheet P. The multiple ink discharging nozzles 57 discharge ink to the sheet P to form an image on the sheet P. It is to be noted that the multiple ink discharging nozzles 57 are arranged on each of the ink discharge heads 56 (see FIG. 2) that are arranged in zigzag arrangement on the head unit 2. To simplify the description, in the figures from FIG. 10 onward, the multiple ink discharging nozzles 57 are depicted to have two rows along the width direction of the sheet P.

As illustrated in FIG. 10, in the process of conveyance of the sheet P in a direction indicated by arrow A, the multiple ink discharging nozzles 57 disposed along the width direction of the sheet P discharge ink to the surface of the sheet P for multiple times, so that an image is formed on the surface of the sheet P. In FIG. 10, a cross-shaped image is formed as an example. According to a combination of the ink discharging nozzles 57 that discharge ink to the sheet P and the difference in densities of ink, a desired image is formed on the sheet P.

Figure 11A:
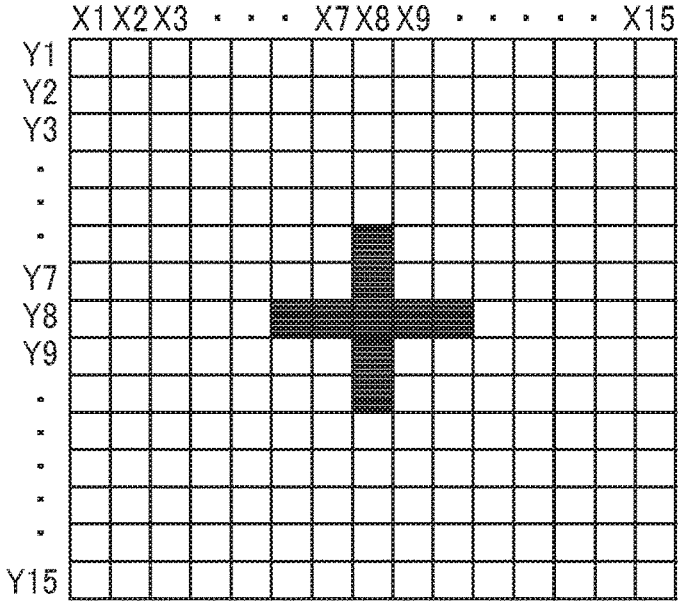
FIGS. 11A and 11B are diagrams illustrating a process of generating ink discharge data.
Figure 11B:
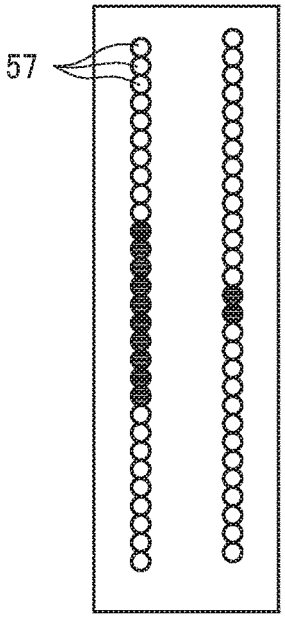

A controller provided to the image forming apparatus 100 reads image information input to the image forming apparatus 100 and generates image data of an image to be formed on the sheet P. For example, FIGS. 11A and 11B are diagrams illustrating a process of generating ink discharge data. As illustrated in FIG. 11A, a cross-shaped image is represented by presence or absence of an image at each coordinate on a grid formed by coordinates X1 to X15 and coordinates Y1 to Y15. For example, coordinates "X8, Y8" indicate that there is an image, coordinates "X9, Y9" indicate that there is no image. Information of the presence or absence of images at the entire coordinates is generated as image data. It is to be noted that the grid of FIG. 11A is a schematic diagram of image data generated by the controller. In an actual operation, a subdivided grid is used. In the actual image forming apparatus 100, color information is inputted to the image data, in addition to the presence or absence of the image. However, to simplify the explanation, the detailed description is omitted.

Then, based on the above-described image data, ink discharge data is generated to determine which of the multiple ink discharging nozzles 57 discharge ink at what timing. The rows of the ink discharging nozzles 57 illustrated in FIG. 11B indicate, for example, an image of lines of X8 and X9 of image data in FIG. 11A is formed. Ink is discharged from the ink discharging nozzles 57 illustrated with black dots. The ink discharge data actually includes the density of ink discharged from each of the ink discharging nozzles 57. By changing the density of ink, the range of ink to adhere to the sheet P is changed.

In a case in which the sheet P has a positional deviation when forming an image to the sheet P, the image to be formed on the sheet P has a positional deviation by the same amount of positional deviation of the sheet P. For example, as illustrated in FIG. 10, since the sheet P has a positional deviation to an upward direction in the width direction of the sheet P (in other words, the center position in the width direction of the sheet P is located at a position shifted to the upward direction from a broken line in FIG. 10), the cross-shaped image to be formed on the sheet P is shifted in a downward direction from the center position in the width direction of the sheet P by the amount of positional deviation of the sheet P. It is to be noted that the broken line in FIG. 10 indicates the possible range of image formation.

With respect to the positional deviation of the image, in the present embodiment, the image forming position is corrected by the above-described amount of image correction of the sheet P. By so doing, the image position of the image to be formed on the sheet P is corrected. There are two specific methods of correcting an image position, which are a method of changing ink discharge data of the ink discharging nozzles 57 and a method of changing the image data.

Next, as an example of methods of correcting the image position, a description is given of a method of correcting an image position when the sheet P has a positional deviation in the width direction of the sheet P (in a case of FIG. 10).

FIGS. 12A through 12F are diagrams for explaining the method of correcting an image forming position.

Figure 12C:
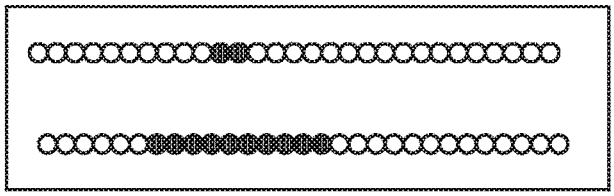
FIGS. 12A through 12F are diagrams for explaining a method of correcting an image forming position.
Figure 12B:
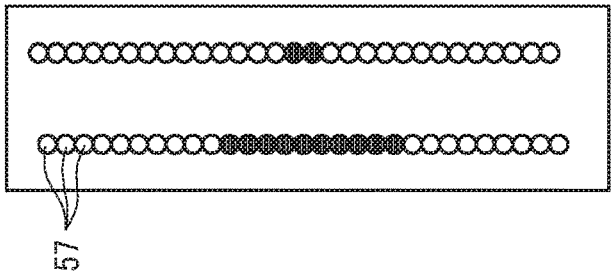
Figure 12A:
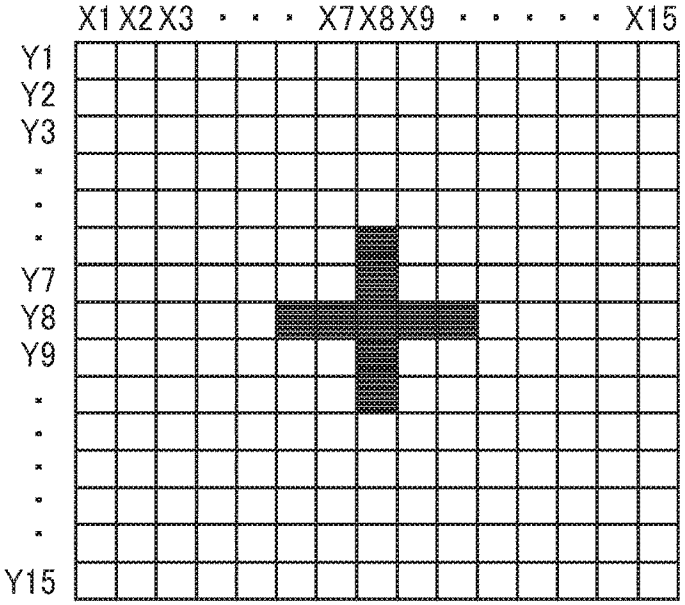

In a case in which ink discharge data is changed, as illustrated in FIGS. 12A through 12C, the same processes are taken as the process in which the image data is not corrected, until the process in which the ink discharge data is formed from the formed image data (i.e., the processes illustrated in FIG. 12A to 12B). Then, by shifting the formed ink discharge data in the width direction, in other words, by sliding the allocation of the multiple ink discharging nozzles 57 that perform an ink discharging operation in the width direction, the image forming position is corrected. To be more specific, as illustrated in FIGS. 12B to 12C, the ink discharging nozzles 57 from which ink is discharged are shifted to the upward direction.

Figure 12D:
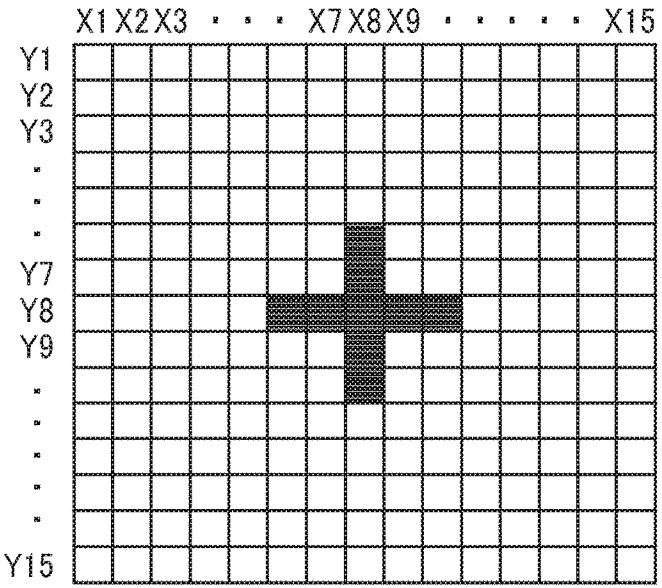
Figure 12E:
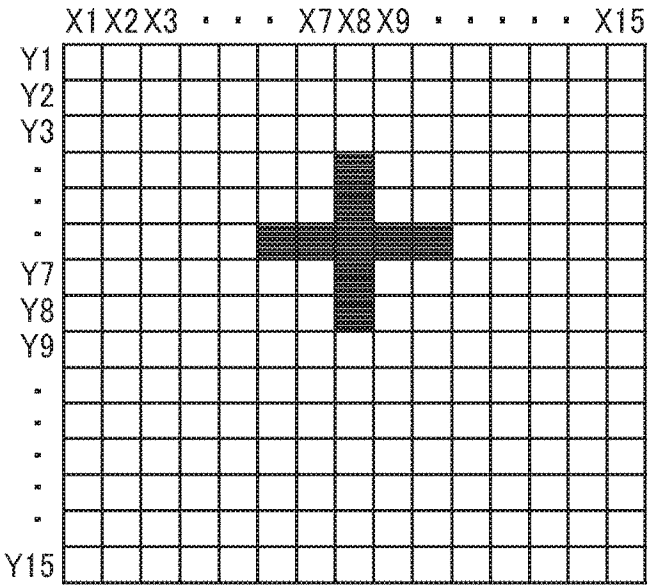
Figure 12F:
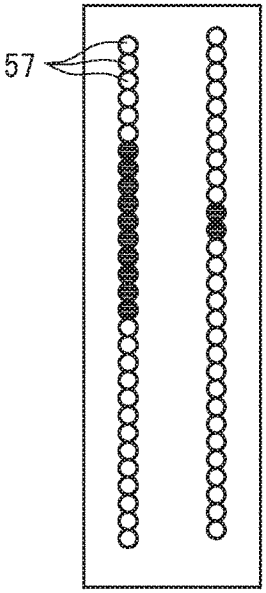

When changing the image data, as illustrated in FIGS. 12D to 12E, the presence or absence of an image of each coordinate is changed to shift the cross-shaped image upwardly. By generating ink discharge data based on the shifted image data, similar to FIGS. 12B and 12C, the allocation of the ink discharging nozzles 57 is changed.

Figure 13:
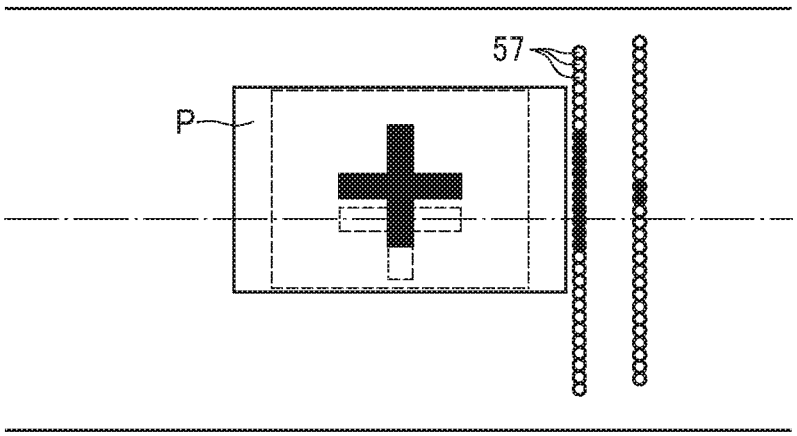
FIG. 13 is a plan view illustrating a state of image formation when the image forming position is corrected.

According to the above-described changes, as illustrated in FIG. 13, an image is formed on a target position by correcting the image forming position. That is, in FIG. 13, the image is formed at the center of the sheet P. It is to be noted that the amount of image correction of the sheet P is determined by the amount of image correction of the sheet P set in step S6 in the flowchart of FIG. 9.

As described above, in the present embodiment, even when the positional deviation of the sheet P is not completely corrected by the pair of sheet gripping rollers 22, the image is formed without generating the positional deviation of the sheet P by correcting the image forming position of the sheet P. Accordingly, even in an image forming apparatus such as a commercial printing machine in which high image quality and high productivity are required, the image forming position of the sheet P is corrected without degrading productivity.

Figure 14B:
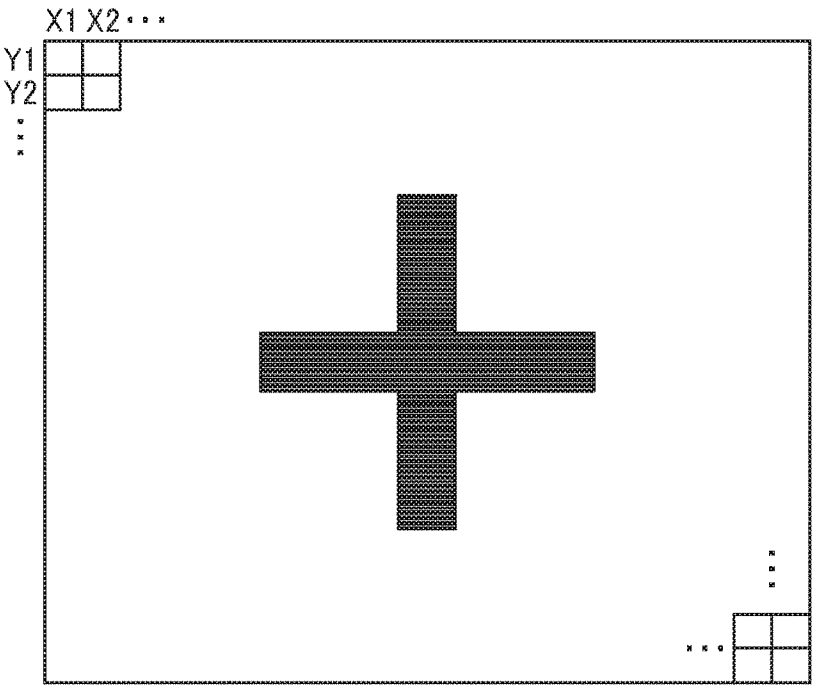
FIGS. 14A and 14B are diagrams illustrating correction of image data by rotating in a rotation direction within a plane of sheet conveyance.
Figure 14A:
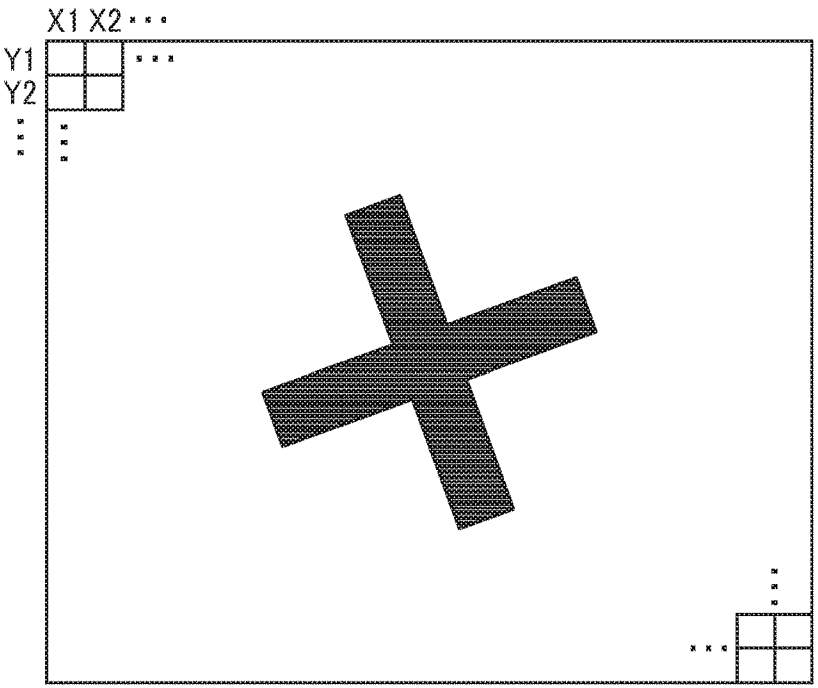

It is to be noted that, in the above description, the image forming position is corrected in the width direction of the sheet P. However, the image forming position may be corrected in the rotation direction within a plane of sheet conveyance of the sheet P. In this case, however, the correction of the positional deviation of the sheet P is achieved by the method of changing image data, not by the method of changing ink discharge data. That is, since the ink discharge data is changed by shifting the ink discharge data generated based on the image data in the width direction of the sheet P, the correction is performed to the positional deviation of the sheet P in the width direction (i.e., the lateral deviation of the sheet P), not to the positional deviation of the sheet P in the rotation direction (i.e., the angular deviation of the sheet P). By contrast, as illustrated in FIGS. 14A and 14B, by changing image data, the positional deviation of the sheet P in the rotation direction, i.e., the angular deviation of the sheet P, within a plane of sheet conveyance is corrected.

Figure 15:
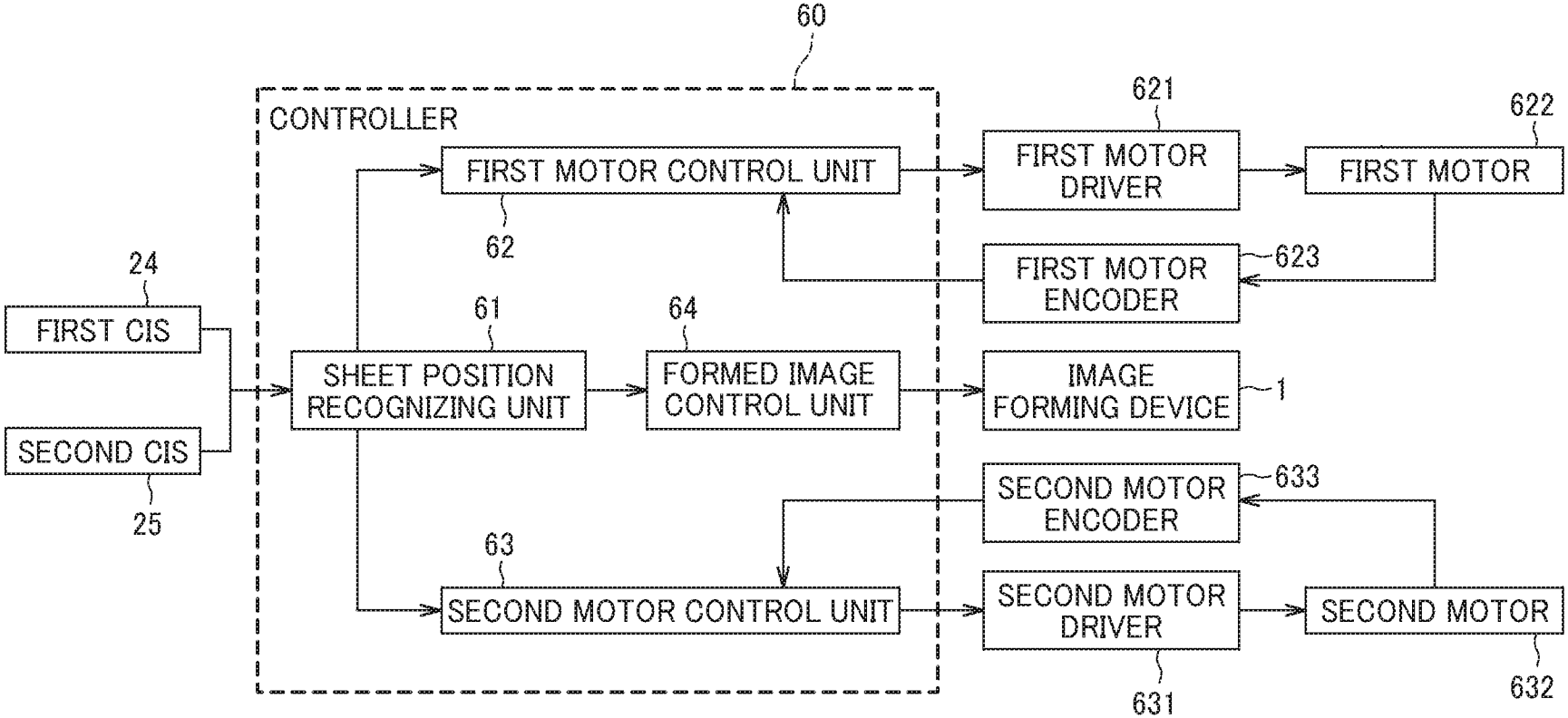
FIG. 15 is a block diagram illustrating a configuration of a controller provided to the image forming apparatus according to an embodiment of this disclosure.

FIG. 15 is a block diagram illustrating a configuration of a controller 60 of the image forming apparatus 100 according to an embodiment of this disclosure. The controller 60 controls the operations performed in the image forming apparatus 100.

As illustrated in FIG. 15, the controller 60 includes a sheet position recognition unit 61, a first motor control unit 62, a second motor control unit 63, and a formed image control unit 64.

The sheet position recognition unit 61 calculates the angular displacement amount of the sheet P and the lateral displacement amount of the sheet P based on detection information received from the first CIS 24 and the second CIS 25. Then, the sheet position recognition unit 61 sends information of the angular and lateral displacement amounts of the sheet P to the first motor control unit 62 and the second motor control unit 63. The sheet position recognition unit 61 calculates the amount of image correction of the sheet P based on the detection results of the first CIS 24 and the second CIS 25 in the final detection. Then, the information of the amount of image correction of the sheet P is transmitted to the formed image control unit 64.

The first motor control unit 62 and the second motor control unit 63 control each movement of the pair of sheet gripping rollers 22 and determine the amount of movement of the pair of sheet gripping rollers 22 based on the information of the angular and lateral displacement amounts of the sheet P sent from the sheet position recognition unit 61.

Specifically, the first motor control unit 62 controls rotation of the pair of sheet gripping rollers 22 within a plane of sheet conveyance. A first motor driver 621 drives a first motor 622 according to a signal sent from the first motor control unit 62 to rotate the pair of sheet gripping rollers 22 within a plane of sheet conveyance. Then, a first motor encoder 623 detects the amount of rotations of the pair of sheet gripping rollers 22 within the plane of sheet conveyance.

The second motor control unit 63 controls movement of the pair of sheet gripping rollers 22 in the width direction. A second motor driver 631 drives a second motor 632 according to a signal sent from the second motor control unit 63 to move the pair of sheet gripping rollers 22 in the width direction. Then, a second motor encoder 633 detects the amount of movement of the pair of sheet gripping rollers 22 in the width direction.

The formed image control unit 64 creates image data and ink discharge data and transmits the ink discharge data to the image forming device 1. Based on the ink discharge data transmitted from the formed image control unit 64, the image forming device 1 discharges ink of each color from the ink discharging nozzles 57 to form an image on the sheet P. In addition, in a case in which information of the amount of image correction of the sheet P is received from the sheet position recognition unit 61, the image forming device 1 changes the image data and the ink discharge data based on the information of the amount of image correction of the sheet P. By so doing, the image forming position is corrected.

Figure 16:
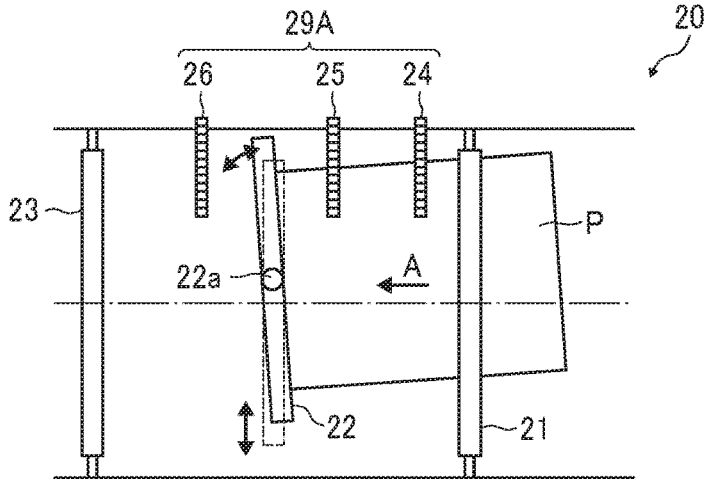
FIG. 16 is a plan view illustrating a process of sheet conveyance performed by the sheet conveying device according to another embodiment of this disclosure.
Figure 17:
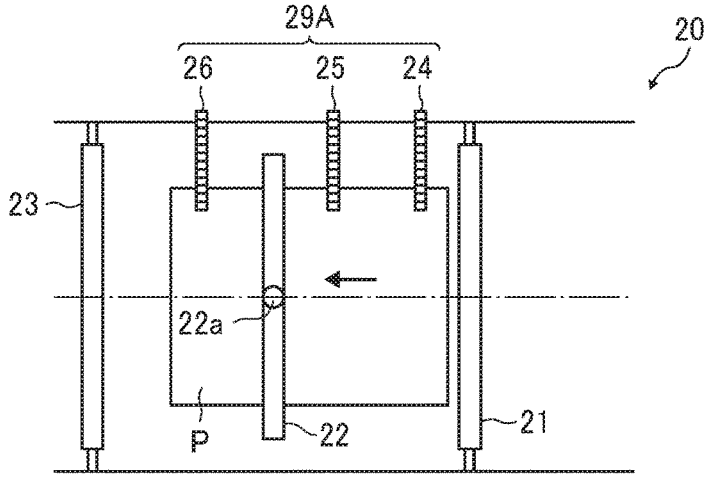
FIG. 17 is a plan view illustrating a subsequent process of sheet conveyance performed by the sheet conveying device of FIG. 16.
Figure 18:
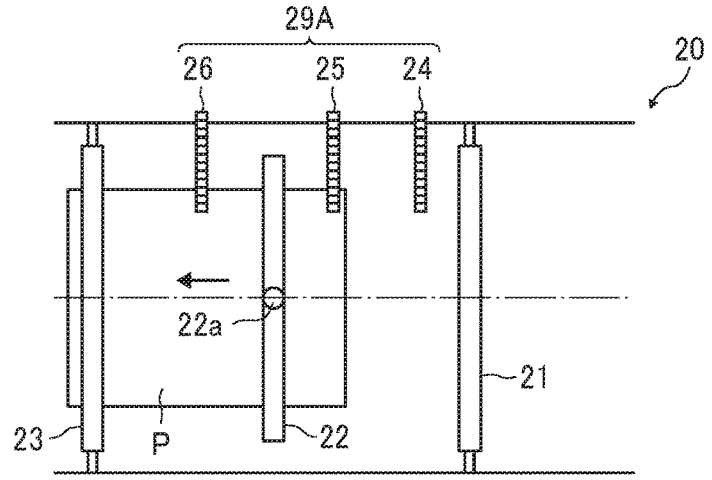
FIG. 18 is a plan view illustrating a subsequent process of sheet conveyance performed by the sheet conveying device of FIG. 17.
Figure 19:
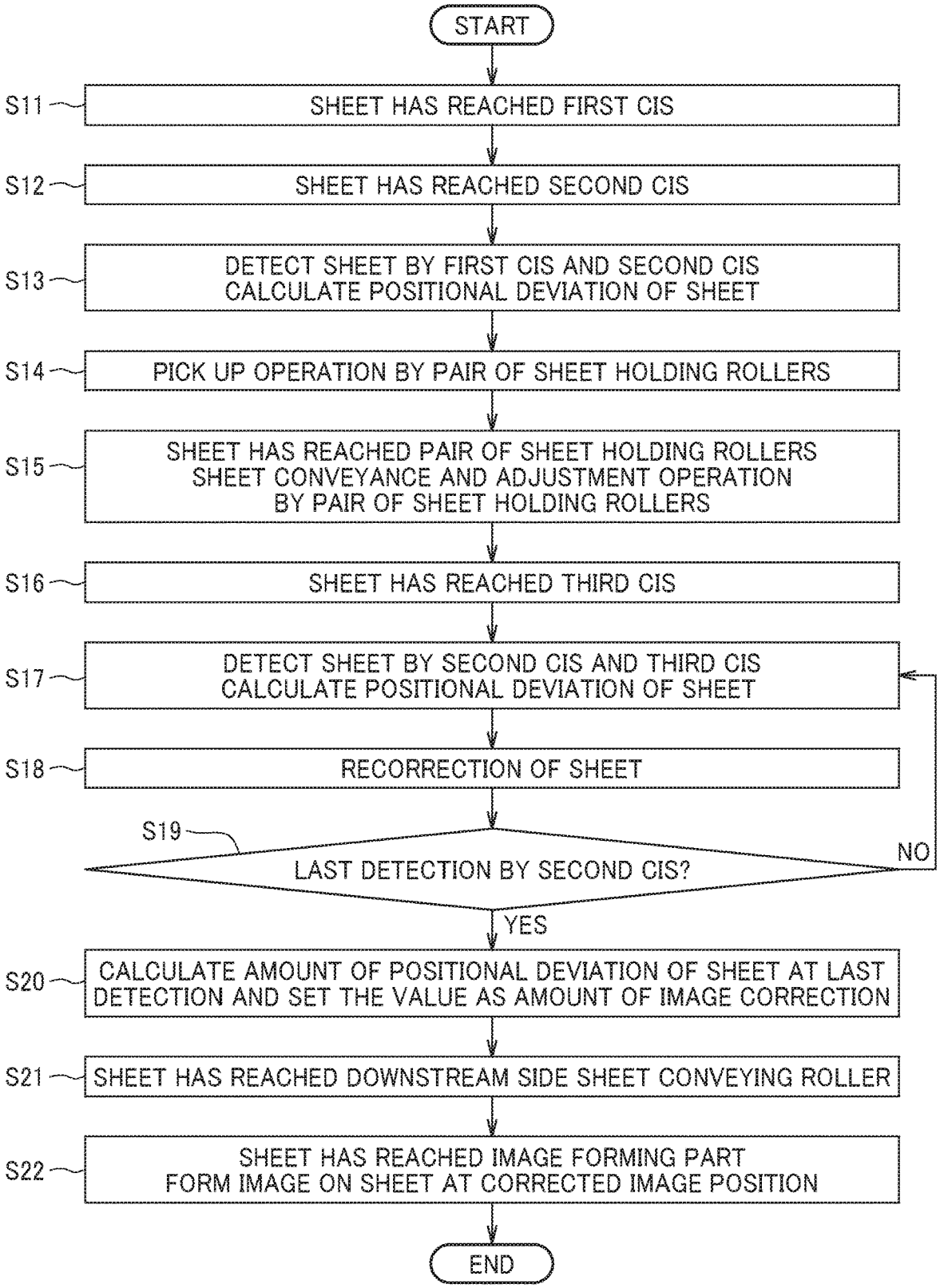
FIG. 19 is a flowchart of sheet conveyance to image formation to a sheet performed by the image forming apparatus as illustrated in FIGS. 16 through 18.

Now, a description is given of the sheet conveying device 20 that has a detecting device 29A having a different configuration from the configuration of the detecting device 29, with reference to FIGS. 16 through 19. Specifically, FIGS. 16, 17, and 18 are diagrams illustrating operations performed by the sheet conveying device 20 with the detecting device 29A and FIG. 19 is a flowchart of the operations of the sheet conveying device 20 of FIGS. 16 through 18 (hereinafter, referred to as "the sheet conveying device 20 of FIG. 16", for convenience).

The sheet conveying device 20 of FIGS. 16 through 18 has the configuration basically identical to the sheet conveying device 20 described above, as illustrated in FIGS. 3 through 7 (hereinafter, referred to as "the sheet conveying device 20 of FIG. 3", for convenience), except that, the sheet conveying device 20 of FIG. 16 includes the detecting device 29A that includes the first CIS 24, the second CIS 25, and a third CIS 26 that functions as a detector disposed downstream from the second CIS 25 and the pair of sheet gripping rollers 22 in the sheet conveying direction. It is to be noted that, in this case, the third CIS 26 functions as an extreme downstream contact image sensor and the second CIS 25 functions as a second extreme downstream contact image sensor. Further, in order to perform a recorrection operation described below, the interval between the pair of sheet gripping rollers 22 and the pair of downstream side sheet conveying rollers 23 is set to be greater than the interval thereof in the sheet conveying device 20 of FIG. 3. It is to be noted that the processes of the sheet conveying device 20 of FIG. 16 from when the sheet P arrives the first CIS 24 to when the sheet P arrives the pair of sheet gripping rollers 22 (i.e., the processes from steps S11 through S15 in the flowchart of FIG. 19), which are the same processes (steps S1 through S5 in the flowchart of FIG. 9) performed by the sheet conveying device 20 of FIG. 3. Accordingly, the description of the processes of steps S11 through S15 is omitted here.

As illustrated in FIG. 16, the pair of sheet gripping rollers 22 performs the adjustment operation in which the pair of sheet gripping rollers 22 corrects positional deviation of the sheet P both in a rotation direction for an angular displacement of the sheet P and in a width direction for a lateral displacement of the sheet P while conveying the sheet P. Different from the sheet conveying device 20 of FIG. 3, the sheet conveying device 20 of FIG. 16 causes the pair of sheet gripping rollers 22 to continue the adjustment operation after the trailing end of the sheet P has passed under the first CIS 24.

Then, as illustrated in FIG. 17, when the sheet P arrives the third CIS 26 (step S16 in the flowchart of FIG. 19), the second CIS 25 and the third CIS 26 detect the position of the sheet P again. Then, the amount of positional deviation of the sheet P is calculated (step S17 in the flowchart of FIG. 19). Then, the pair of sheet gripping rollers 22 moves in the rotation direction within a plane of sheet conveyance and in the width direction, so that the recorrection operation to correct positional deviation of the sheet P is performed again (step S18 in the flowchart of FIG. 19).

The detection of the position of the sheet by the second CIS 25 and the third CIS 26 and the recorrection by the pair of sheet gripping rollers 22 based on the detection results of the second CIS 25 and the third CIS 26 are performed repeatedly until the trailing end of the sheet P arrives the second CIS 25, in other words, until the second CIS 25 detects the sheet P for the last time, i.e., a final detection by the second CIS 25 (steps S17 through 19 in the flowchart of FIG. 19). Specifically, the amount of positional deviation of the sheet P calculated based on the detection results of the second CIS 25 and the third CIS 26 are fed back to the pair of sheet gripping rollers 22 at each detection. In other words, the controller 60 performs a feedback control to continuously notify the updated amount of positional deviation of the sheet P to the pair of sheet gripping rollers 22. According to the above-described operations, the positional deviation of the sheet P is corrected with high accuracy.

In the present embodiment, the timing at which the trailing end of the sheet P passes under the second CIS 25, as illustrated in FIG. 18, is the timing of detection of the sheet on the extreme downstream side where the amount of angular displacement of the sheet P is calculated. Accordingly, as described above, the amount of positional deviation of the sheet P is calculated based on the detection results of the second CIS 25 and the third CIS 26 at the timing at which the second CIS 25 has detected the sheet P for the last time (i.e., the timing at which the last detection of the sheet P is performed, that is, the timing of the final detection of the second CIS 25), and the calculated amount of positional deviation of the sheet P is set as the amount of image correction of the sheet P. At this point, the recorrection operation performed by the pair of sheet gripping rollers 22 is completed. The processes from when the sheet P arrives the pair of downstream side sheet conveying rollers 23 to when an image is formed on the sheet P (steps S20 through S22 in the flowchart of FIG. 19) are the same as the processes (steps S6 through S8 in the flowchart of FIG. 9) performed by the sheet conveying device 20 of FIG. 3. Accordingly, the description of the processes of steps S20 through S22 is omitted here.

In the configuration of the sheet conveying device 20 of FIG. 16, the positional deviation of the sheet P is corrected highly accurately due to the adjustment operation and the recorrection operation performed by the pair of sheet gripping rollers 22. Therefore, the amount of image correction of the sheet P is reduced. Accordingly, even with an image forming apparatus that is not capable of setting a large amount of correction of the image forming position on the sheet P due to, for example, insufficient numbers of arranged ink discharging nozzles, an image is performed on the sheet P without generating any positional deviation of the image forming position.

The pair of sheet gripping rollers 22 moves quicker in the rotation direction within a plane of sheet conveyance when compared with movement in the width direction. Therefore, according to the configuration of a sheet conveying device, it is likely that the detected angular displacement of the sheet P is sufficiently corrected by the correction operation (i.e., the adjustment operation and the recorrection operation) performed by the pair of sheet gripping rollers 22. In this case, the image forming position is corrected for the positional deviation of the sheet P in the width direction but is not corrected in the rotation direction within a plane of sheet conveyance. According to this configuration, the final detection of the sheet P is performed by the pair of sheet gripping rollers 22 at a further downstream position in the sheet conveying direction, and therefore the correction operation performed by the pair of sheet gripping rollers 22 continues to a further downstream side of the sheet conveying direction.

Specifically, when the image forming position of the sheet P is corrected in the width direction alone, in other words, when the amount of positional deviation is corrected in the width direction of the sheet P alone in the final detection, it is sufficient to provide a single CIS for detecting the sheet P. Therefore, for example, as illustrated in FIG. 7, in the configuration of the detecting device 29 in which the first CIS 24 and the second CIS 25 are provided as the detectors, when the image forming position is corrected in the width direction of the sheet P alone, the final detection is set to a timing at or before which the trailing end of the sheet P passes under the second CIS 25. Accordingly, when compared with the timing of the sheet conveying device 20 of FIG. 3 (i.e., the timing at which the trailing end of the sheet P passes under the first CIS 24, see FIG. 6), the sheet conveying device of FIG. 16 obtains the amount of positional deviation of the sheet P that is calculated at the further downstream side of the sheet conveying direction is set as the amount of image correction of the sheet P. Further, the correction operation performed by the pair of sheet gripping rollers 22 is continued to the further downstream side of the sheet conveying direction.

It is to be noted that, in a case in which the timing at which the sheet P reaches the pair of downstream side sheet conveying rollers 23, in other words, the timing at which the pair of sheet gripping rollers 22 completes sheet conveyance of the sheet P and separates from the sheet P, is earlier than the timing at which the trailing end of the sheet P passes under the second CIS 25, the timing of the final detection may be set to a timing at which the sheet P reaches the pair of downstream side sheet conveying rollers 23. Alternatively, contrary to the above-described configuration, the pair of sheet gripping rollers 22 may correct the image forming position of the sheet P in the width direction (i.e., the lateral displacement of the sheet P) without correcting the image forming position of the sheet P in the rotation direction within a plane of sheet conveyance (i.e., the angular displacement of the sheet P).

Figure 20:
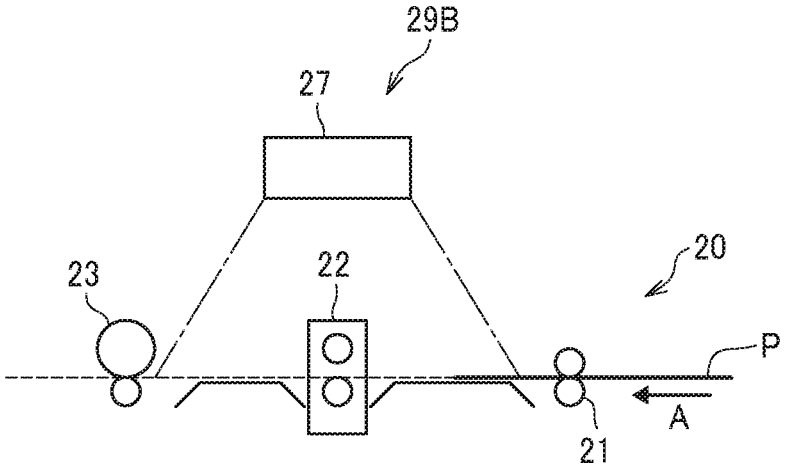
FIG. 20 is a side view illustrating a detecting device according to another embodiment of this disclosure.

FIG. 20 is a side view illustrating a detecting device 29B according to another embodiment of this disclosure.

As illustrated in FIG. 20, the sheet conveying device 20 of FIG. 3 and the sheet conveying device 20 of FIG. 16 may include the detecting device 29B including a camera (image capturing device) 27 as a detector, instead of contact image sensors (i.e., the first CIS 24, the second CIS 25, and the third CIS 26). The camera 27 is disposed above the sheet conveyance passage of the sheet P, so as to capture the sheet P that is conveyed by the sheet conveying device 20 from above.

The photographing range of the camera 27 is set, for example, from a position immediately downstream from the pair of upstream side sheet conveying rollers 21 to a position immediately upstream from the pair of downstream side sheet conveying rollers 23. The camera 27 is disposed such that an imaging surface of the camera 27 is parallel to the surface of the sheet P being conveyed in the sheet conveyance passage.

When the sheet P is conveyed in the sheet conveying device 20 (i.e., the sheet conveying device 20 of FIG. 3 and the sheet conveying device 20 of FIG. 16), the camera 27 captures images of the sheet P continuously. Then, the controller 60 identifies the gradations of colors of the surface and background of the sheet P on the captured image, so that the position of the sheet P and the amount of positional deviation of the sheet P are calculated. Therefore, by capturing the image on the sheet P by the camera 27, the amount of positional deviation of the sheet P for the pick up operation, the adjustment operation, and the recorrection operation performed by pair of sheet gripping rollers 22 and the amount of image correction of the sheet P for the image forming operation are calculated.

In the configuration of the sheet conveying device 20 including the detecting device 29B, as long as the sheet P moves within the photographing range of the camera 27, the amount of angular displacement of the sheet P (i.e., the amount of positional deviation of the sheet P in the rotation direction within a plane of sheet conveyance) is calculated. Therefore, the possible range for calculating the amount of angular displacement of the sheet P is provided on the further downstream side of the sheet conveying direction. Accordingly, the amount of positional deviation of the sheet P calculated at a position on the further downstream side corresponds to the amount of image correction of the sheet P and the correction operation performed by pair of sheet gripping rollers 22 is continued to the further downstream side.

It is to be noted that the sheet conveying device 50 (see FIG. 1) that functions as a second sheet conveying device may have the same configuration as the sheet conveying device 20 described above. Accordingly, even when an image is formed on the back face of the sheet P, the image forming position is corrected and the positional deviation of an image to be formed on the sheet P is prevented.

The above-described embodiments are illustrative and do not limit this disclosure. It is therefore to be understood that within the scope of the appended claims, numerous additional modifications and variations are possible to this disclosure otherwise than as specifically described herein.

In addition, the "sheet" includes the sheet P (plain papers), thick papers, postcards, envelopes, thin papers, coated papers (coated papers, art papers, etc.), tracing papers, OHP sheets, plastic films, prepreg, copper foil, etc.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus comprising:

a detecting device configured to detect a position of a sheet;

a pair of sheet conveying bodies configured to convey the sheet and correct a positional deviation of the sheet;

an image forming device configured to form an image on the sheet; and circuitry configured to:

calculate a first positional deviation amount of the sheet based on a first detection result of the position of the sheet by the detecting device;

cause the pair of sheet conveying bodies to correct the positional deviation of the sheet based on the first positional deviation amount;

calculate a second positional deviation amount of the sheet based on a second detection result of the position of the sheet by the detecting device; and cause the image forming device to correct a positional deviation of an image forming position on the sheet based on the second positional deviation amount, wherein the circuitry is further configured to cause the image forming device to correct the positional deviation of the image forming position in a width direction of the sheet, wherein the image forming device includes a plurality of ink discharging nozzles from which liquid is discharged onto the sheet to form an image on the sheet, and wherein the circuitry is further configured to:

generate image data of an image to be formed on the sheet by the image forming device;

generate ink discharge data used to determine allocation of the plurality of ink discharging nozzles to discharge the liquid onto the sheet based on the image data;

slide the allocation of the plurality of ink discharging nozzles determined based on the ink discharge data in the width direction of the sheet; and cause the image forming device to correct the positional deviation of the image forming Position on the sheet in the width direction of the sheet.

2. The image forming apparatus according to claim 1, wherein the circuitry is configured to:

generate image data of an image to be formed on the sheet by the image forming device;

change the image data; and cause the image forming device to correct the image forming position on the sheet based on the image data changed.

3. The image forming apparatus according to claim 1, wherein the circuitry is configured to cause the image forming device to correct the image forming position in a rotation direction of the sheet within a plane of sheet conveyance of the sheet.

4. The image forming apparatus according to claim 1, wherein the detecting device includes a plurality of contact image sensors arranged along a sheet conveying direction of the sheet.

5. The image forming apparatus according to claim 4, wherein the plurality of contact image sensors includes an extreme downstream contact image sensor and a second extreme downstream contact image sensor, wherein the circuitry is configured to:

cause the second extreme downstream contact image sensor and the extreme downstream contact image sensor to detect the position of the sheet when a trailing end of the sheet passes the second extreme downstream contact image sensor;

calculate a positional deviation amount of the sheet based on detection results of the second extreme downstream contact image sensor and the extreme downstream contact image sensor; and cause the image forming device to correct the image forming position on the sheet based on the positional deviation amount of the sheet.

6. The image forming apparatus according to claim 4, wherein the plurality of contact image sensors includes an extreme downstream contact image sensor, wherein the image forming device is configured to correct the image forming position on the sheet in a width direction of the sheet, wherein the circuitry is configured to:

cause the extreme downstream contact image sensor to detect the position of the sheet when a trailing end of the sheet passes the extreme downstream contact image sensor;

calculate a positional deviation amount in the width direction of the sheet based on a detection result of the extreme downstream contact image sensor; and cause the image forming device to correct the image forming position on the sheet based on the positional deviation amount of the sheet.

7. The image forming apparatus according to claim 1, wherein the detecting device includes an image capturing device configured to capture an image of at least a portion of the sheet, and wherein the circuitry is configured to:

calculate at least one of the first positional deviation amount and the second positional deviation amount of the sheet based on the image of at least the portion of the sheet captured by the image capturing device; and cause the image forming device to correct the image forming position on the sheet based on the at least one of the first positional deviation amount and the second positional deviation amount of the sheet.

8. The image forming apparatus according to claim 1, wherein the positional deviation of the image forming position on the sheet is correctable by at least one of changing ink discharging data of at least one of the ink discharging nozzles and changing the image data.

9. The image forming apparatus, comprising:

a detecting device configured to detect a position of a sheet, the detecting device including a plurality of contact image sensors arranged along a sheet conveying direction of the sheet;

a pair of sheet conveying bodies configured to convey the sheet and correct a positional deviation of the sheet;

an image forming device configured to form an image on the sheet; and circuitry configured to:

calculate a first positional deviation amount of the sheet based on a first detection result of the position of the sheet by the detecting device;

cause the pair of sheet conveying bodies to correct the positional deviation of the sheet based on the first positional deviation amount;

calculate a second positional deviation amount of the sheet based on a second detection result of the position of the sheet by the detecting device; and cause the image forming device to correct a positional deviation of an image forming position on the sheet based on the second positional deviation amount, wherein the plurality of contact image sensors includes a first contact image sensor, a second contact image sensor, and a third contact image sensor disposed from an upstream side to a downstream side of the sheet conveying direction, wherein the circuitry is configured to:

cause the first contact image sensor and the second contact image sensor to detect the position of the sheet;

calculate the first positional deviation amount of the sheet based on detection results of the position of the sheet by the first contact image sensor and the second contact image sensor;

cause the pair of sheet conveying bodies to correct the positional deviation of the sheet based on the t positional deviation amount;

cause the second contact image sensor and the third contact image sensor to detect the position of the sheet;

calculate the second positional deviation amount of the sheet based on detection results of the position of the sheet by the second contact image sensor and the third contact image sensor; and cause the pair of sheet conveying bodies to perform re-correction of the positional deviation of the sheet based on said second positional deviation amount, and wherein the circuitry is configured to perform a feedback control during the re-correction.

10. A method of correcting a positional deviation of a sheet, the method comprising:

detecting a position of the sheet by at least one of an image capturing device and a plurality of image sensors;

calculating a first positional deviation amount of the sheet based on a first detection result of the position of the sheet;

causing a pair of sheet conveying bodies to correct the positional deviation of the sheet based on the first positional deviation amount;

detecting the position of the sheet again;

calculating a second positional deviation amount of the sheet based on a second detection result of the position of the sheet;

causing an image forming device to correct an image forming position on the sheet based on the second positional deviation amount;

causing the image forming device to correct the image forming position in a width direction of the sheet;

generating image data of an image to be formed on the sheet by the image forming device;

generating ink discharge data used to determine allocation of a plurality of ink discharging nozzles to discharge liquid onto the sheet based on the image data;

sliding the allocation of the plurality of ink discharging nozzles determined based on the ink discharge data in the width direction of the sheet; and causing the image forming device to correct the image forming position to the sheet in the width direction of the sheet.

11. The method according to claim 10, further comprising:

generating image data of an image to be formed on the sheet by the image forming device;

changing the image data; and causing the image forming device to correct the image forming position on the sheet based on the image data changed.

12. The method according to claim 10, further comprising:

causing the image forming device to correct the image forming position in a rotation direction of the sheet within a plane of sheet conveyance of the sheet.

13. The method according to claim 10, further comprising:

causing an extreme downstream contact image sensor and a second extreme downstream contact image sensor of the plurality of image sensors to detect the position of the sheet when a trailing end of the sheet passes the second extreme downstream contact image sensor of the plurality of image sensors;

calculating a positional deviation amount of the sheet based on detection results of the second extreme downstream contact image sensor and the extreme downstream contact image sensor; and causing the image forming device to correct the image forming position on the sheet based on the positional deviation amount of the sheet.

14. The method according to claim 10, further comprising:

correcting the image forming position in a width direction of the sheet;

causing an extreme downstream contact image sensor of the plurality of image sensors to detect the position of the sheet when a trailing end of the sheet passes the extreme downstream contact image sensor;

calculating a positional deviation amount of the sheet in the width direction of the sheet based on a detection result of the extreme downstream contact image sensor; and causing the image forming device to correct the image forming position on the sheet based on the positional deviation amount of the sheet.

15. The method according to claim 10, further comprising:

causing a first contact image sensor and a second contact image sensor of the plurality of image sensors to detect the position of a sheet;

calculating the first positional deviation amount of the sheet based on detection results of the position of the sheet by the first contact image sensor and the second contact image sensor;

causing a pair of sheet conveying bodies to correct the positional deviation amount of the sheet based on the first positional deviation amount;

causing the second contact image sensor and a third contact image sensor of the plurality of image sensors to detect the position of the sheet;

calculating the second positional deviation amount of the sheet based on detection results of the position of the sheet by the second contact image sensor and the third contact image sensor;

causing the pair of sheet conveying bodies to perform re-correction of the positional deviation of the sheet based on said second positional deviation amount; and performing a feedback control during the re-correction.

16. The method according to claim 10, wherein the positional deviation of the image forming position on the sheet is correctable by at least one of changing ink discharging data of at least one of the ink discharging nozzles and changing the image data.

* * * * *